US009217424B2

(12) United States Patent
Ottemann et al.

(10) Patent No.: US 9,217,424 B2
(45) Date of Patent: Dec. 22, 2015

(54) MULTI-SPEED HYDRAULIC PUMP

(75) Inventors: William C. Ottemann, Fallbrook, CA (US); Charles J. Lob, Oconomowoc, WI (US); Joseph R. Young, Colgate, WI (US)

(73) Assignee: Harken, Inc., Pewaukee, WI (US)

( * ) Notice: Subject to any disclaimer, the term of this patent is extended or adjusted under 35 U.S.C. 154(b) by 504 days.

(21) Appl. No.: 13/587,342

(22) Filed: Aug. 16, 2012

(65) Prior Publication Data

US 2013/0047836 A1 Feb. 28, 2013

Related U.S. Application Data

(60) Provisional application No. 61/525,436, filed on Aug. 19, 2011.

(51) Int. Cl.

| | |
|---|---|
| ***F04B 9/00*** | (2006.01) |
| ***F04B 9/04*** | (2006.01) |
| ***F04B 1/04*** | (2006.01) |
| ***F04B 1/07*** | (2006.01) |
| ***F04B 49/12*** | (2006.01) |

(52) U.S. Cl.

CPC ..... *F04B 9/045* (2013.01); *F04B 1/0413* (2013.01); *F04B 1/0421* (2013.01); *F04B 1/07* (2013.01); *F04B 49/125* (2013.01)

(58) Field of Classification Search

CPC ..... F16H 21/14

USPC ..... 92/72, 73; 417/221, 223, 237; 91/293, 91/294, 492

See application file for complete search history.

(56) References Cited

U.S. PATENT DOCUMENTS

| | | | | |
|---|---|---|---|---|
| 2,070,935 | A | | 2/1937 | Traut |
| 2,472,104 | A | | 1/1947 | Grant et al. |
| 2,801,593 | A | * | 8/1957 | Moshacher ..... 418/182 |
| 2,836,120 | A | * | 5/1958 | Navarro ..... 92/12.1 |
| 3,690,097 | A | * | 9/1972 | Widmaier ..... 60/429 |
| 3,730,125 | A | * | 5/1973 | Krueger ..... 114/109 |
| 3,738,230 | A | * | 6/1973 | Censi ..... 92/13.3 |
| 3,792,747 | A | | 2/1974 | Knutson |

(Continued)

FOREIGN PATENT DOCUMENTS

WO WO2007059222 5/2007

OTHER PUBLICATIONS

Search Report mailed Oct. 26, 2012 for PCT/US2012/051144.

(Continued)

*Primary Examiner* — Nathaniel Wiehe
*Assistant Examiner* — Dustin T Nguyen
(74) *Attorney, Agent, or Firm* — Brian G. Gilpin; Godfrey & Kahn, S.C.

(57) ABSTRACT

Hydraulic pump applications sometimes require the pump to be able to provide relatively low pressure with larger amounts of fluid moved, while other applications call for relatively higher pressures but less fluid moved. The multi-speed hydraulic pump can operate at multiple speeds so as to provide multiple outputs of pressure and flow. In a two-mode version, the pump has one mode of operation that provides for lower pressure/more fluid moved and another mode of operation that provides for higher pressure/less fluid moved. Having multiple modes of operation in the pump allows for a single pump to provide greater movement or greater pressure while working within the limits of the force or speed at which the pump is actuated.

19 Claims, 11 Drawing Sheets

(56) References Cited

U.S. PATENT DOCUMENTS

| | | | | |
|---|---|---|---|---|
| 4,032,263 | A * | 6/1977 | Pareja | 417/539 |
| 4,056,072 | A | 11/1977 | Bergstrom | |
| 5,078,580 | A * | 1/1992 | Miller et al. | 417/265 |
| 5,199,857 | A * | 4/1993 | Sanuki | 417/319 |
| 7,963,209 | B2 * | 6/2011 | Olsen et al. | 92/12.2 |
| 2004/0071560 | A1 | 4/2004 | Cho et al. | |
| 2007/0176484 | A1 | 8/2007 | Reuter et al. | |

OTHER PUBLICATIONS

Harken 2011 Catalog.
Harken 2011 One Design Catalog.

* cited by examiner

MULTI-SPEED HYDRAULIC PUMP

CROSS-REFERENCE TO RELATED APPLICATION

This application is based on and claims priority to U.S. Provisional Patent Application No. 61/525,436 filed on Aug. 19, 2011, the disclosure of which is incorporated herein by reference in its entirety for all purposes.

FIELD OF THE INVENTION

The present invention relates generally to hydraulic pumps. More particularly, the present invention relates to a hydraulic pump capable of operating at multiple speeds.

BACKGROUND

In the sport of sailing and particularly in sailboat racing, it has been known to use hydraulic pumps to provide force that is applied to various rigging and hull components. Uses of hydraulics have included but not been limited to tensioning stays, shrouds and other rigging elements; exerting force directly on masts or other spars; swinging, extending or retracting hull appendages; and other uses. Often the hydraulic systems installed to provide the force are manual systems. There are several reasons for the use of such manually actuated systems but the initial goal for development of an improved hydraulic pump was for installation on racing sailboats.

Most sailboat racing rules do not permit the use of an on-board internal combustion engine while racing. Without an engine running during a race, a hydraulic system would need to have a pump driven by an electrical motor or by manual human power. Hydraulic systems actuated by electric motors would typically draw a great deal of power from a battery installation. Providing a large enough capacity battery bank to supply the needed amperage might add a great deal of unnecessary or undesirable weight to a racing sailboat. Other sources of electrical energy, such as solar cells or wind generators are also not able to provide the level of energy required to operate the motor driving the pump, or would add undesirable weight in potentially undesirable locations or add excess windage that would hinder the performance or operation of a sailboat.

So, for most sailing installations, hydraulics driven by human powered pumps are a conventional approach and improvements to such manual pumps are desirable to maximize the efficiency of the pumps. It should be noted that improvements to pumps for human operation may also be applied to electrically driven or engine driven pumps as well, to improve overall efficiency in the operation of hydraulic pumps generally.

SUMMARY OF THE INVENTION

In hydraulic pump applications, there are some situations that require relatively low pressure with larger amounts of fluid moved, while other situations call for relatively higher pressures but less fluid moved. The pump of the present disclosure is a pump that is capable of operating at multiple speeds so as to provide multiple outputs of pressure and flow. It provides for one mode of operation that provides for lower pressure/more fluid moved and another mode of operation that provides for higher pressure/less fluid moved. Alternative embodiments could include additional modes of operation with varying degrees of pressure/fluid movement parameters.

For manual pumps in a sailing application, a limiting factor to the operation of a hydraulic pump can be the amount of force that can be generated by one or more sailors actuating handles, winches, or grinder pedestals connected to the drive the pump. Another limiting factor may be the speed at which the sailor(s) are able to actuate the pump. The at least two modes of operation in the pump of the present disclosure allow for the same pump to provide greater movement or greater pressure while working within the limits of the force or speed at which the sailor(s) may be able to actuate the pump.

It will be understood by those skilled in the art that one or more aspects of this invention can meet certain objectives, while one or more other aspects can lead to certain other objectives. Other objects, features, benefits and advantages of the present invention will be apparent in this summary and descriptions of the disclosed embodiment, and will be readily apparent to those skilled in the art. Such objects, features, benefits and advantages will be apparent from the above as taken in conjunction with the accompanying figures and all reasonable inferences to be drawn therefrom

BRIEF DESCRIPTION OF THE DRAWINGS

The accompanying drawing figures, which are incorporated in and constitute a part of the description, illustrate several aspects of the invention and together with the description, serve to explain the principles of the invention. A brief description of the figures is as follows.

DESCRIPTION

Reference will now be made in detail to exemplary aspects of the present invention which are illustrated in the accompanying drawings. Wherever possible, the same reference numbers will be used throughout the drawings to refer to the same or like parts.

In hydraulics applications, there are some situations that require relatively low pressure with larger amounts of fluid moved, while other situations call for relatively higher pressures but less fluid moved. The pump of the present disclosure provides for one mode of operation that provides for lower pressure/more fluid moved and another mode of operation that provides for higher pressure/less fluid moved. Without departing from the present invention, alternative embodiments could be designed with additional modes of operation with varying degrees of pressure/fluid movement parameters. For manual pumps in a sailing application, one limiting factor may be the amount of force that can be generated by one or more sailors actuating handles, winches or grinder pedestals connected to the drive the pump. Another limiting factor may be the speed at which the sailor(s) are able to actuate the pump. The at least two modes of operation in the pump of the present disclosure allow for the same pump to provide greater movement or greater pressure while working within the limits of the force or speed at which the sailor(s) may be able to actuate the pump.

Figure 1:
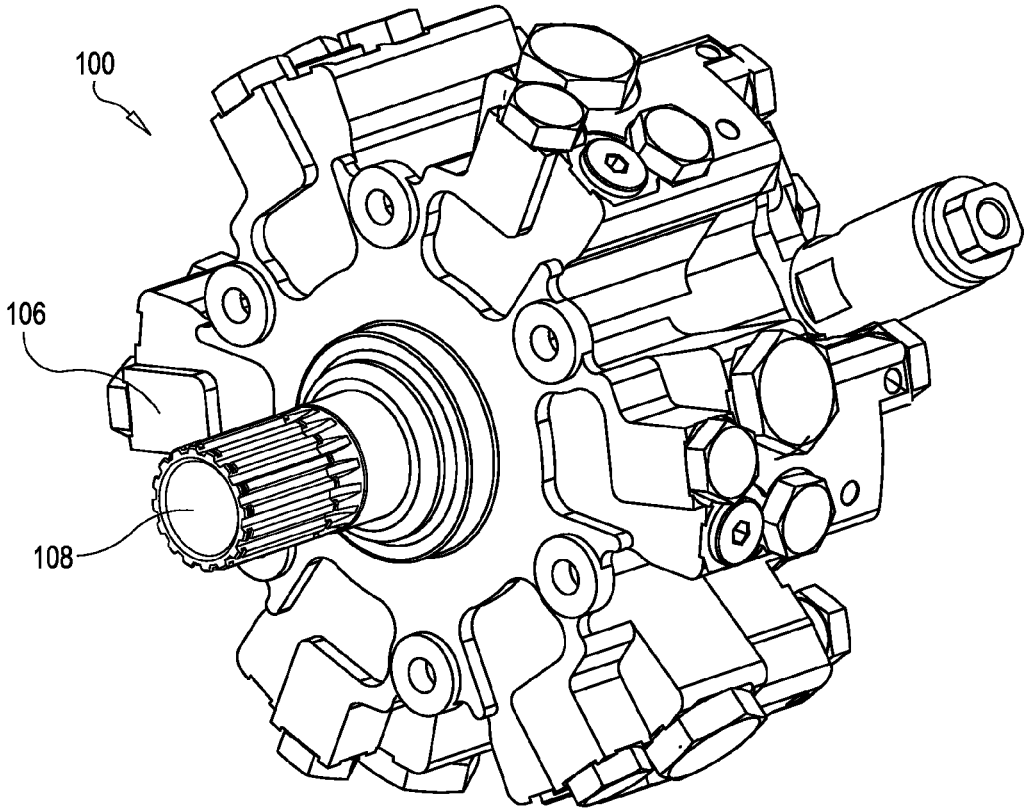
FIG. 1 is a perspective view of one embodiment of a hydraulic pump according to the present disclosure.
Figure 2:
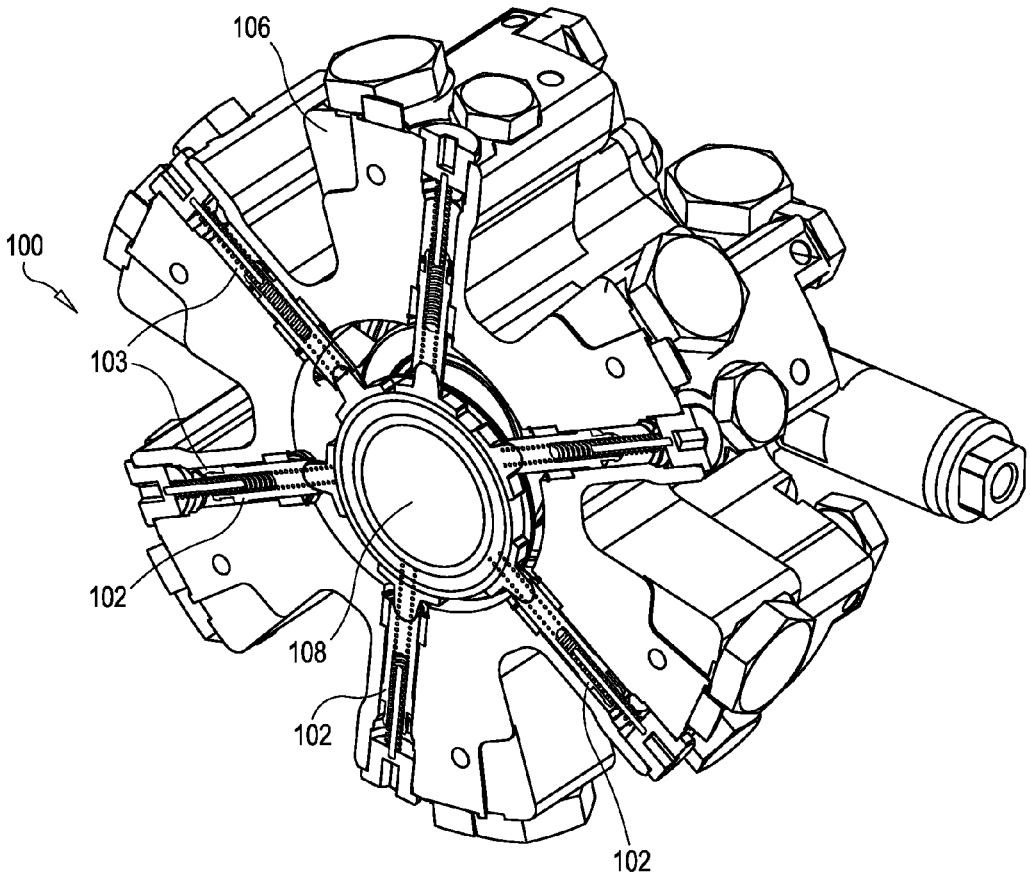
FIG. 2 is a perspective cross-sectional view of the hydraulic pump of FIG. 1, with the cross-section taken through a set of smaller volume pistons.
Figure 3:
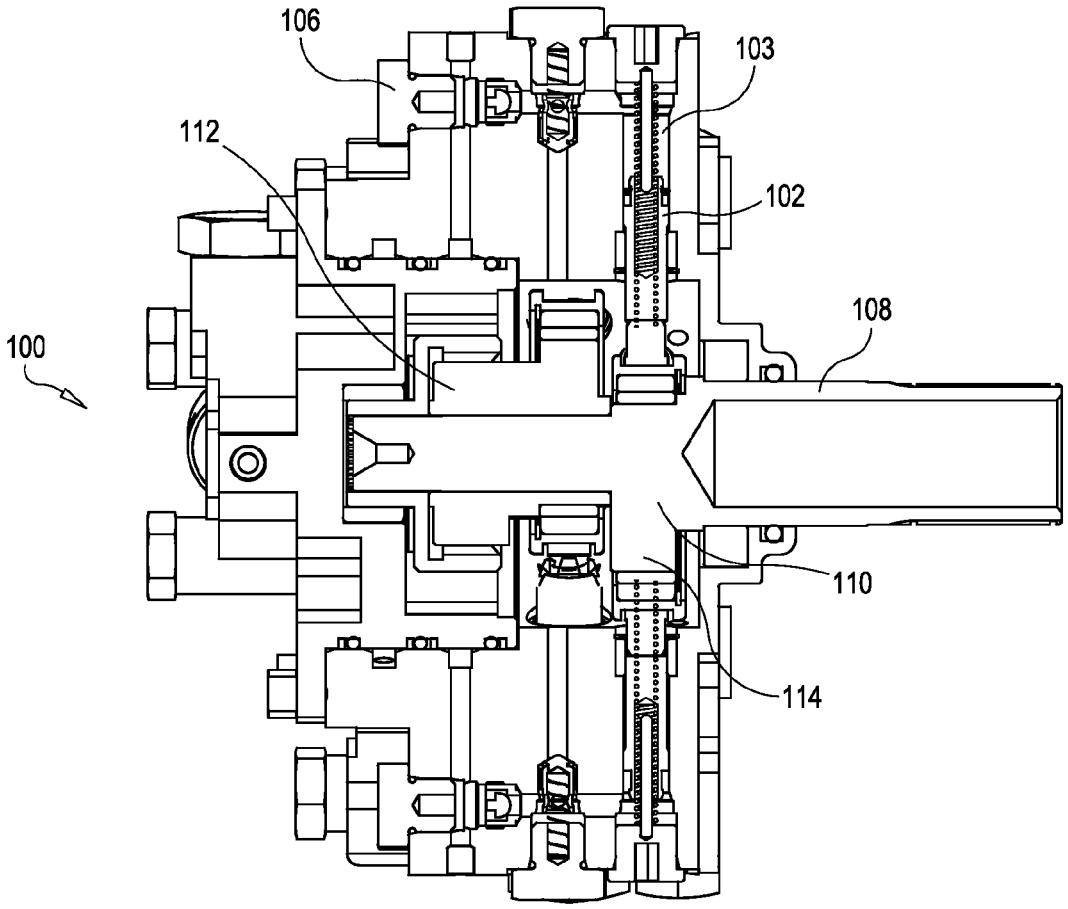
FIG. 3 is a side cross-sectional view of the hydraulic pump of FIG. 1, with the cross-section taken through a center line of a central shaft.
Figure 5:
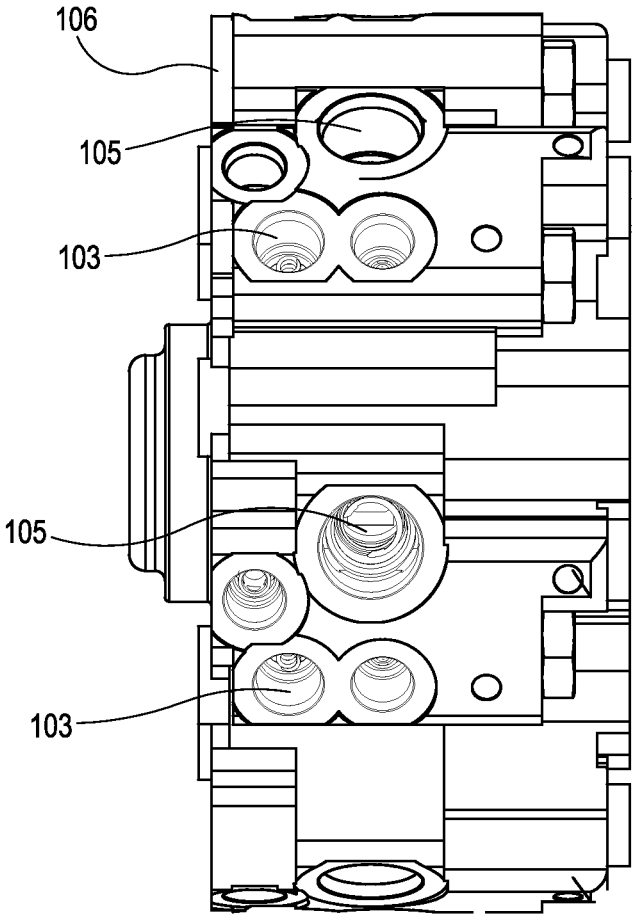
FIG. 5 is a side view of a body of the pump of FIG. 1, showing both large and small diameter cylinders.
Figure 6:
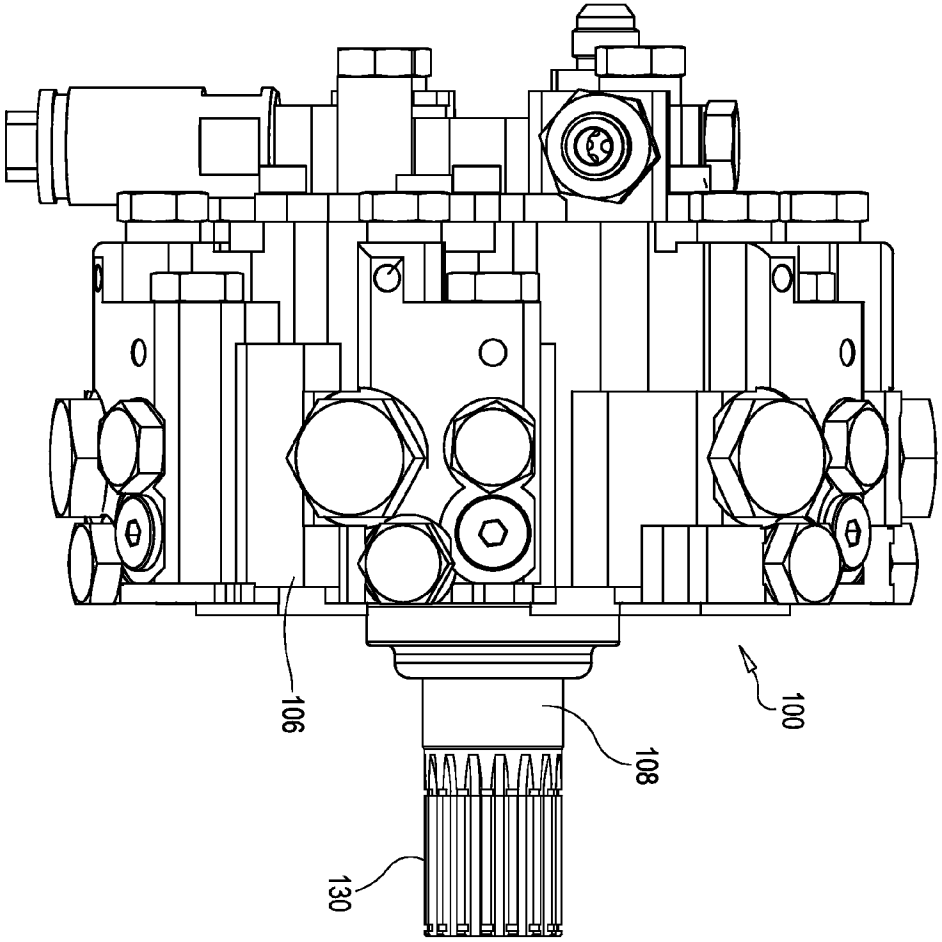
FIG. 6 is a side view of the pump of FIG. 1.
Figure 7:
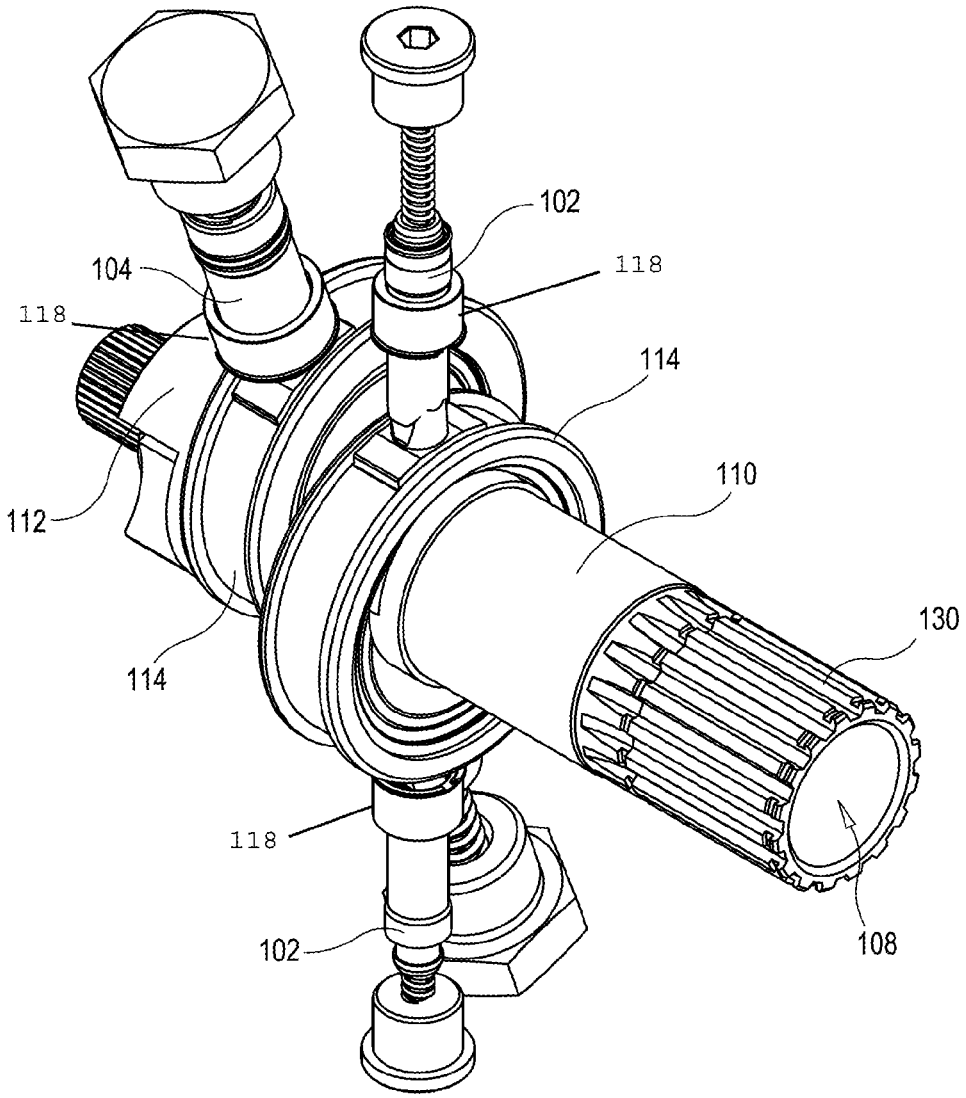
FIG. 7 is a perspective view of the central shaft of the pump of FIG. 1, removed from the housing and including two small pistons and two large pistons.
Figure 8:
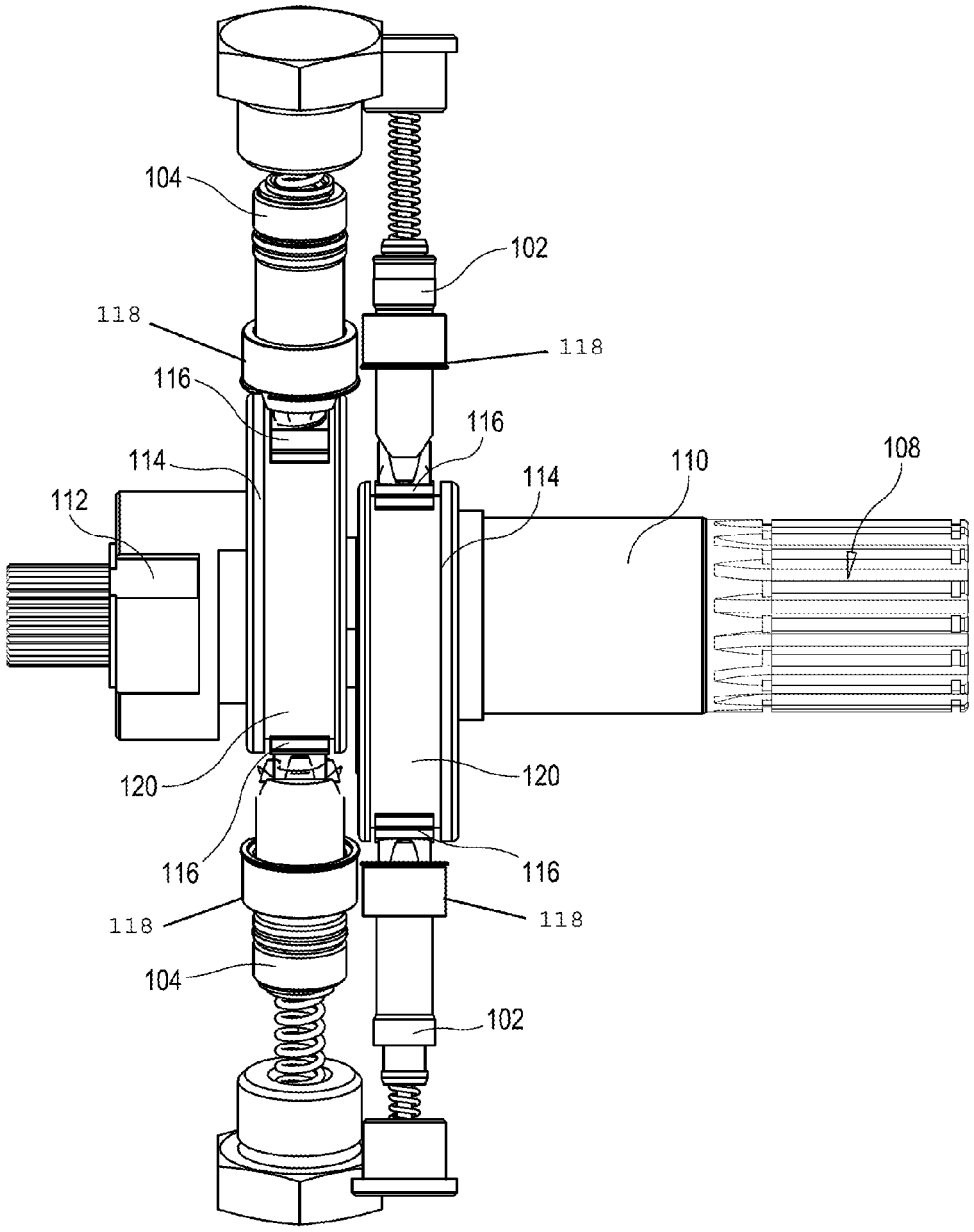
FIG. 8 is a side view of the central shaft and pistons of FIG. 7.

FIGS. 1 to 3 illustrate a first embodiment of a hydraulic pump 100 according to the present disclosure. Pump 100 is configured as a two speed pump with a first set of a plurality of small pistons 102 (shown in FIG. 3) mounted within a first set of a plurality of small cylinders 103 (shown in FIG. 3). Pump 100 is further configured with a second set of a plurality of large pistons 104 (shown in FIG. 7) mounted within a second set of large cylinders 105 (shown in FIG. 5).

A central shaft assembly 108 rotates within a pump body 106 to actuate the pistons and move them radially in and out within the cylinders. Shaft assembly 108 has a fixed portion 110 and a ratcheted portion 112. Each portion 110 and 112 includes an eccentric or cam 114 that engages one of the sets of pistons. Portion 110 engages small pistons 102 while portion 112 engages large pistons 104. The shape of eccentric 114 of each portion may be shaped identically or each portion may have a uniquely shaped eccentric.

A set of shoes 116 is shown in place between each piston 102 and 104 and the eccentric 114 engaging the piston. Shoe 116 preferably fits within a cup 118 formed in a base of each piston to permit articulation of the shoe with respect to the piston as the shoe rides along a circumferential groove 120 formed on an outer surface of eccentric 114. Shoes 116 permit pistons 102 and 104 to be made of the most appropriate material for driving hydraulic fluid within the bore within regard to the durability or wear-resistance of the material. Shoes 116 are preferably made of a lubricious and wear-resistant material that will not be excessively worn while the outer surface of eccentric 114 passing beneath the shoe. Shoes 116 also serve to spread the load between the piston and the eccentric over a greater area, reducing the pressure acting on the bearing surface between the two elements.

Portion 110 is fixed as part of shaft assembly 108 and rotates with shaft assembly 108 regardless of the direction of rotation of the shaft assembly. This means that whenever shaft assembly 108 is rotated, pump 100 will generate hydraulic pressure with small pistons 102. Portion 112 is preferably ratcheted to shaft assembly 108 so that movement of shaft assembly 108 is a first direction will rotate eccentric 114 of portion 112 while rotation of shaft assembly 108 in the opposite direction will NOT rotate eccentric 114 of portion 112. This means that rotation of shaft assembly 108 in the first direction will cause pump 100 to generate hydraulic pressure with both large pistons 104 and small pistons 102. Rotation of shaft assembly 108 in the second opposite direction will cause pump 100 to generate hydraulic pressure with only small pistons 102.

The use of different sized pistons permits pump 100 to provide two distinct modes of hydraulic pressure, depending on the direction of rotation of shaft assembly 108. Rotation in the first direction, such that both eccentrics 114 are turning and moving pistons 102 and 104 will permit a relatively greater volume of hydraulic fluid to be provided by pump 100. This higher volume will be provided at a relatively lower pressure. Rotation of the shaft assembly in the second opposite direction, such that only eccentric 114 of fixed portion 110 is turning and moving only pistons 102 will permit pump 100 to provide a relatively lower volume of hydraulic fluid but a relatively higher pressure. So, for a given sailing crew's ability to provide rotational energy through a grinding pedestal, pump 100 permits the relative work of the pump to be matched to the task at hand, which may require a greater amplitude of movement or may require a greater force to be applied by a hydraulic piston or device receiving fluid from pump 100.

Other aspects of pump 100 with regard to hydraulic fluid flow and regulation are illustrated within the drawings and may not be otherwise described in the specification. These aspects are intended to be part of the present disclosure and are not admitted as being in the prior art.

Figure 4:
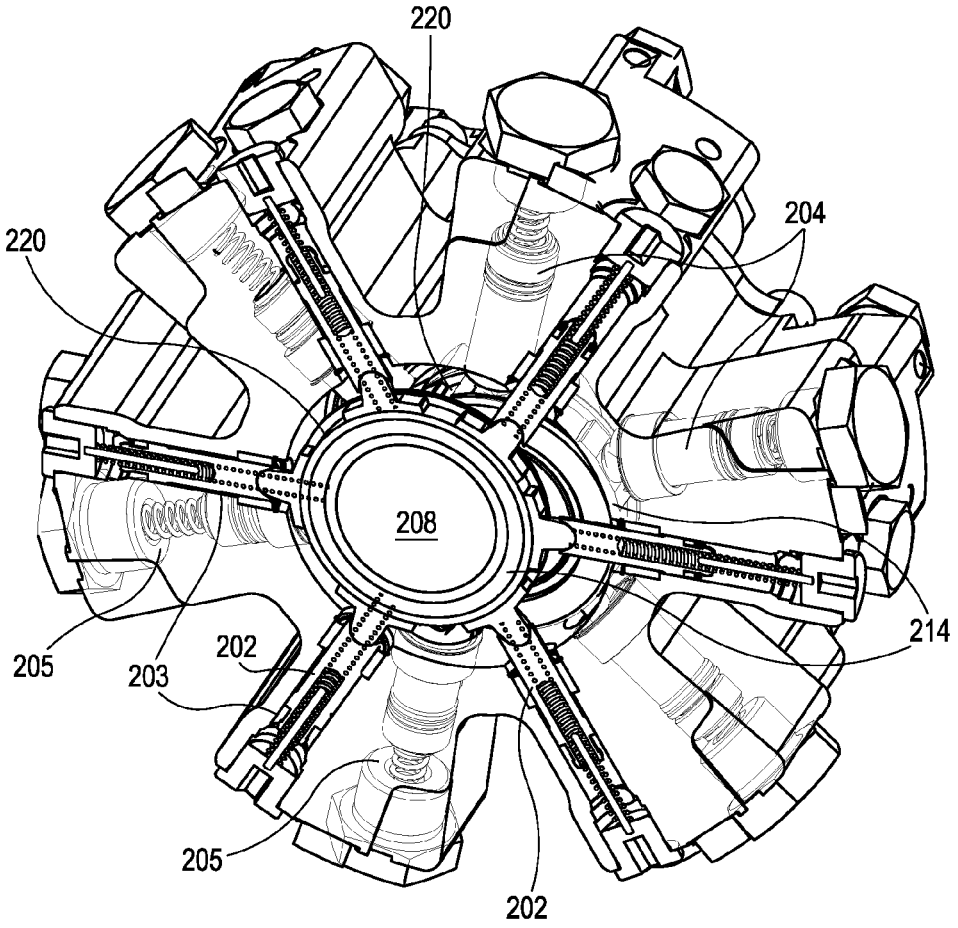
FIG. 4 is a perspective cross-sectional view of one alternative embodiment of a hydraulic pump according to the present disclosure.

FIG. 4 illustrates a second embodiment of pump 200 which is similar in configuration and operation to pump 100. However, in pump 200, a plurality of small pistons 202 in small cylinders 203 and a plurality of large pistons 204 in large cylinders 205 ride directly against an outer surface 20 of a pair of eccentrics 214 which are part of a shaft assembly 208. For such a configuration, it is desirable that the inner portion of each piston be made of a durable, wear resistant material to reduce the need for maintenance or replacement of parts after use of pump 200. Wear may also be increased on outer surface 220 so the inclusion of materials or surface treatments to provide greater wear resistance on eccentrics 214 may also be desirable.

FIGS. 7 to 11 illustrate shaft assembly 108 more closely. Portion 110 may include splines 130 or other configuration that is adapted to engage a source of rotational energy. For a racing sailboat, such a source of energy might be but is not limited to a shaft from a pedestal grinder or a series of linked pedestal grinders. Pedestal grinders permit crew members of a sailboat to operate handles that translate the crews effort into rotation of an output shaft. Typically, rotation of the handles in a first direction will rotate the output shaft in a first direction and rotation of the handles in a second direction will rotate the output shaft in a second direction. This will permit the grinder pedestal to take advantage of the variable operation of pump 100.

The connection between the handles and the shaft may also be geared to provide mechanical advantage. It is known for such pedestal grinders to have a first mechanical advantage ratio when the handles are rotated in one direction and a second mechanical advantage ratio when the handles are rotated in the opposite direction. Such a multi-speed grinder pedestal, used in conjunction with pump 100, may permit the high volume or high pressure operation of pump 100 to be magnified. Alternatively, since pump 100 already provides for selection between high volume or high pressure operation, a simpler pedestal with a single mechanical advantage ratio regardless of direction of movement of the handles may be used.

As the portions 110 and 112 are not locked in rotational position with respect to each other, the relative location of the higher and lower portions of each eccentric 114 will not be fixed. The relative rotational position of eccentrics 114 shown in FIGS. 7 to 11 is illustrative only. To keep the effort required to rotate shaft assembly 108 relatively constant in any given direction, it may be preferable to have a plurality of pistons spaced apart radially about shaft assembly 108. Pump 100 is illustrated with six pistons 102 and six pistons 104 equally spaced apart about the shaft portion 108. More or fewer pistons may be used within the scope of the present disclosure and it is not intended to limit the present disclosure to any particular number of pistons. It is further not intended to limit the present disclosure to having the same number of small and large pistons. It is further not intended to require that the pistons engaging eccentric 114 of fixed portion 110 be different in size from the pistons engaging eccentric 114 of ratcheted portion 112. The same pistons may be used with respect to each eccentric and pump 100 will still provide a relatively greater volume of fluid when rotated in the first direction as opposed to the second direction.

Figure 9:
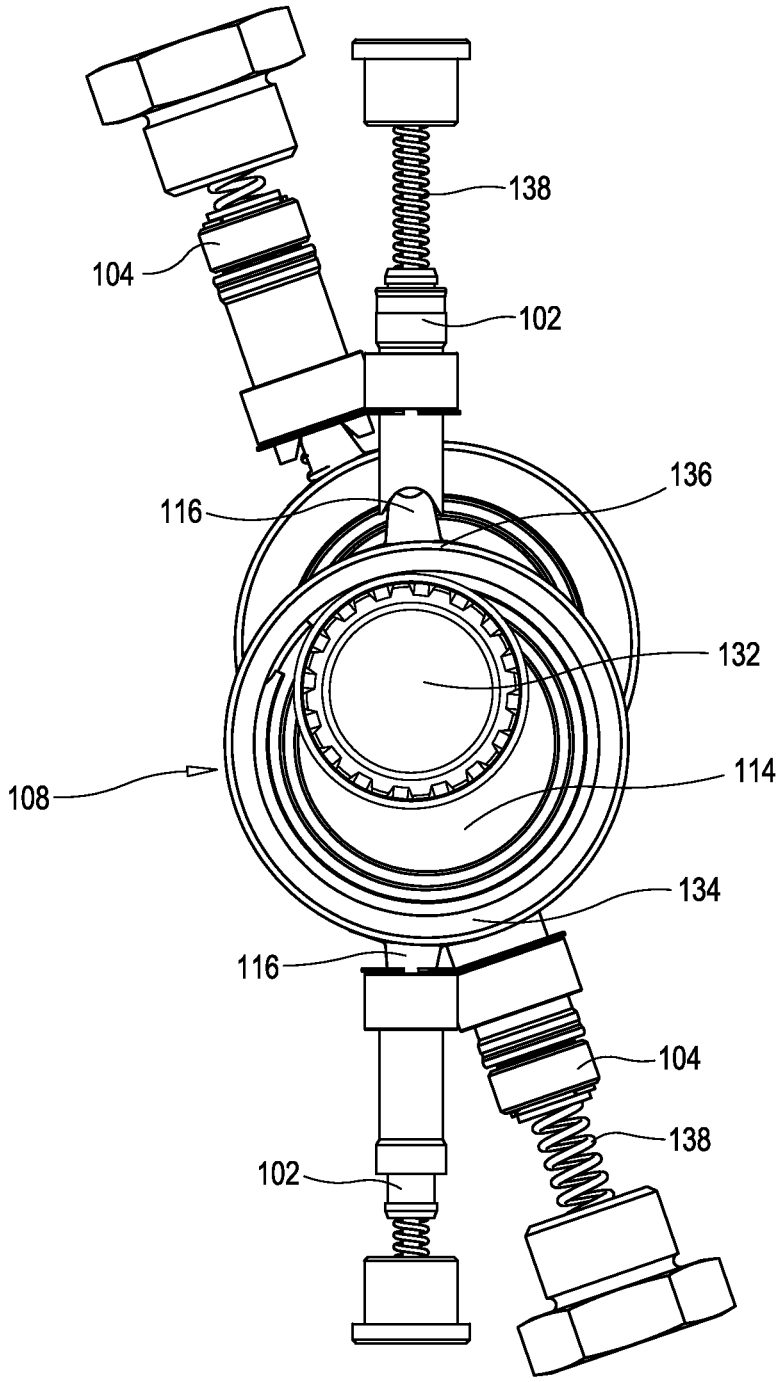
FIG. 9 is a first end view of the central shaft and pistons of FIG. 7.
Figure 10:
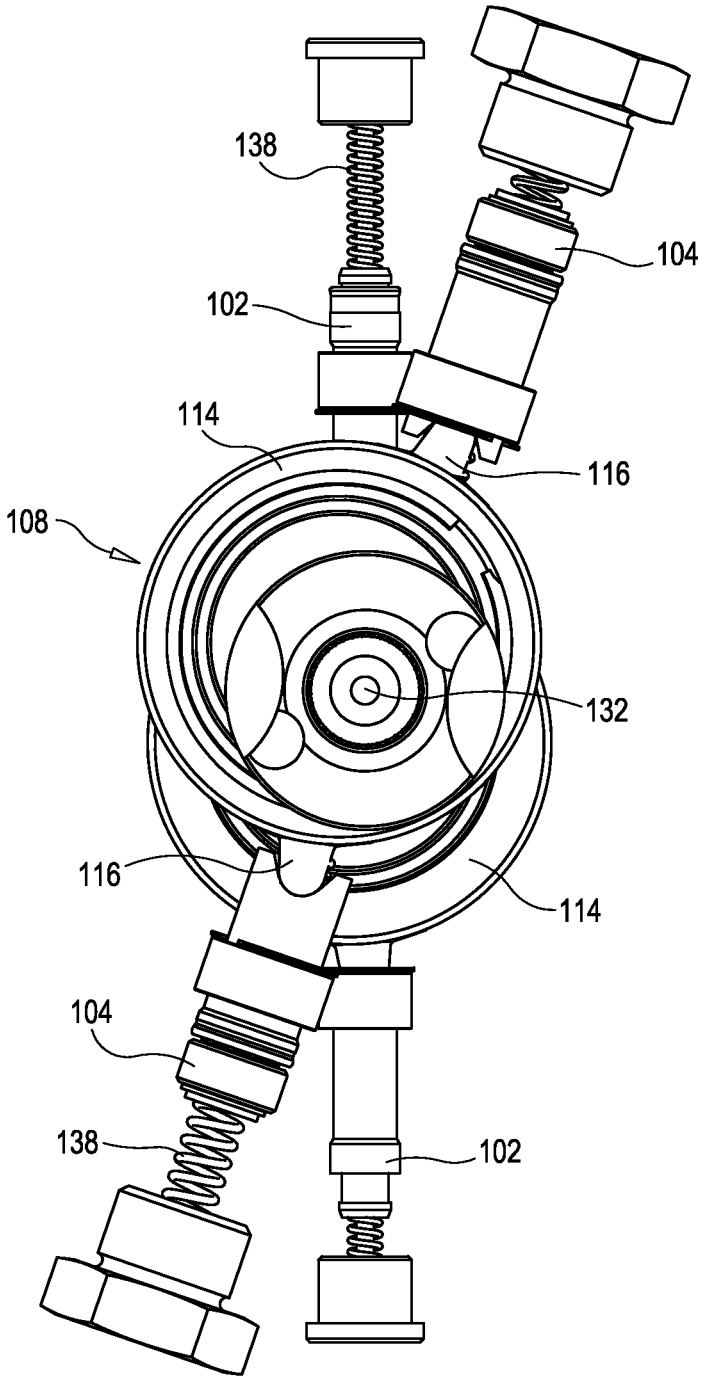
FIG. 10 is a second end view of the central shaft and pistons of FIG. 7.
Figure 11:
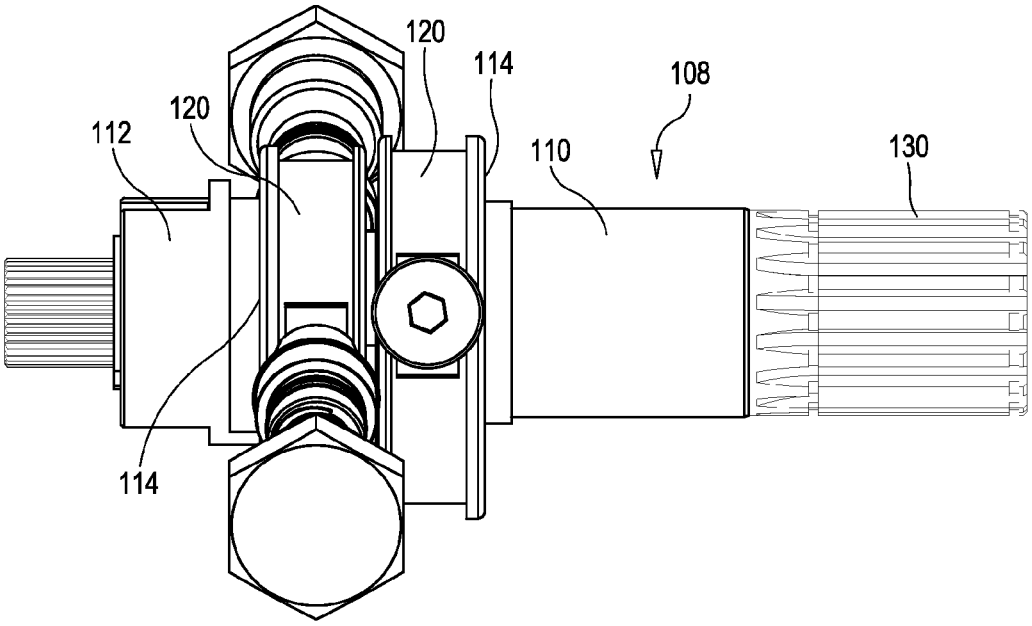
FIG. 11 is a second side view of the central shaft and pistons of FIG. 7.

The diameter of the pistons, the number of pistons engaging the same eccentric, and the amplitude of movement of each piston caused by the eccentric will determine the level of hydraulic pressure that may be generated by pump 100 for a given amount of rotational force being applied to splines 130. As shown in FIGS. 9 and 10, each eccentric 114 has a cam profile that engages shoes 116 to push the respective pistons away from the center of rotation 132 of shaft assembly 108. At a point of highest lift 134, the piston engaged is pushed to the maximum extent into its respective cylinder. As the eccentric turns approximately half a turn, a point of least lift 136 engages the piston, permitting a spring 138 to push the piston back within its cylinder toward the shaft assembly. As shown in FIGS. 9 and 10, the top piston 102 is approximately at the point of least lift 136, while the lower piston 102 is approximately at the point of greatest lift 134.

Eccentrics 114 are shown with a generally consistent profile between the point of greatest lift 134 and the point of least lift 136, but it is anticipated that the particular curvature of each eccentric may be adapted to be different profiles. It is known to alter cam profiles to change the speed of lift at different portions of rotation between least and greatest lift. Also, given that shoes 116 and/or pistons 203/205 may be riding along an outer surface of each eccentric 114/214, it may be desirable to have a more uniform curvature of the outer surface so that shoes 116 may be shaped to provide the greatest possible bearing surface to reduce wear. The shape of the eccentric profile may be selected to improve efficiency of hydraulic pressure generated, change the speed to increase in pressure during rotation, reduce wear on parts, or for other reasons not specified herein but which would be within the experience of persons skilled in the arts of hydraulic pumps and cam profiles in other applications.

While the present disclosure has been directed primarily to pumps driven by human power, it is anticipated that elements of the present disclosure may also be used in pumps driven by non-human means. While the present disclosure primarily illustrates pumps that provide two modes of operation, pumps with additional modes of operation could be designed without departing from the invention. The present disclosure may also be used to develop pumps which permit smaller motors to provide both high speed actuation and high pressure actuation. The present disclosure may also be used to permit motors driving hydraulic pumps to operate in a more efficient rpm range for both high speed actuation and high pressure actuation.

While the invention has been described with reference to preferred embodiments, it is to be understood that the invention is not intended to be limited to the specific embodiments set forth above. Thus, it is recognized that those skilled in the art will appreciate that certain substitutions, alterations, modifications, and omissions may be made without departing from the spirit or intent of the invention. Accordingly, the foregoing description is meant to be exemplary only, the invention is to be taken as including all reasonable equivalents to the subject matter of the invention, and should not limit the scope of the invention set forth in the following claims.

What is claimed is:

1. A hydraulic pump comprising:

a body with a first plurality of cylinders and a second plurality of cylinders defined radially about a central shaft assembly rotatably mounted within the body;

a piston in each of the first and second pluralities of cylinders, with each moveable in the cylinder, wherein outward movement of the piston in the cylinder will pump hydraulic fluid;

the central shaft assembly including a selective engagement mechanism and at least two eccentrics, a first eccentric fixed to rotate with a first portion of the central shaft assembly, and a second eccentric fixed to rotate with a second portion of the central shaft assembly, the first and second portions of the central shaft assembly configured such that:

the first eccentric engages the pistons in the first plurality of cylinders and rotation of the central shaft assembly in either direction about a center of rotation will rotate the first portion such that the first eccentric will move the pistons in the first plurality cylinders;

the second eccentric engages the pistons in the second plurality of cylinders and rotation of the central shaft assembly in a first direction about the center of rotation will rotate the second portion such that the second eccentric will move the pistons in the second plurality of cylinders; and rotation of the central shaft assembly in a second direction opposite the first direction about the center of rotation will not rotate the second portion and the pistons in the second plurality of cylinders will not move.

2. The hydraulic pump of claim 1, further comprising a shoe fitted between each piston and the eccentric configured to engage and move each piston.

3. A hydraulic pump comprising:

a shaft rotatably mounted at least partially within the hydraulic pump;

a first plurality of cylinders and a second plurality of cylinders wherein each of the first and second pluralities of cylinders has a piston and is positioned radially from the shaft; and a selective engagement mechanism such that when the shaft is rotated in first direction the selective engagement mechanism enables engagement of the pistons from the first plurality of cylinders and prevents engagement of the pistons from the second plurality of cylinders and when the shaft is rotated in a second direction the selective engagement mechanism allows engagement of the pistons from the first and second pluralities of cylinders.

4. A hydraulic pump comprising:

a shaft rotatably mounted at least partially within the hydraulic pump;

a first plurality of cylinders and a second plurality of cylinders wherein each of the first and second pluralities of cylinders has a piston and is positioned radially from the shaft; and wherein rotation of the shaft in a first direction engages the pistons from the first plurality of cylinders but not the pistons from the second plurality of cylinders and rotation of the shaft in a second direction engages the pistons from the first and second pluralities of cylinders.

5. The hydraulic pump of claim 4, further comprising a first eccentric and a second eccentric connected to the shaft, such that when the shaft is rotated in the first direction, the first eccentric engages the pistons from the first plurality of cylinders and when the shaft is rotated in the second direction the second eccentric engages the pistons from the second plurality of cylinders.

6. The hydraulic pump of claim 5, wherein the rotation of the shaft in the first direction engages a ratchet connected between the second eccentric and the shaft such that the second eccentric does not engage any pistons from the second plurality of cylinders.

7. The hydraulic pump of claim 5, wherein the first eccentric has an outer surface with a first groove formed there around and the second eccentric has an outer surface with a second groove formed there around such that the pistons from the first plurality of cylinders engages the first groove and the pistons from the second plurality of cylinders engages the second groove.

8. The hydraulic pump of claim 4, further comprising a first cam and a second cam connected to the shaft, such that the first cam engages the pistons from the first plurality of cylinders and the second cam engages the pistons from the second plurality of cylinders.

9. The hydraulic pump of claim 8, wherein the shaft has a disengagement portion such that rotation of the shaft in the first direction prevents the second cam from engaging any pistons from the second plurality of cylinders.

10. The hydraulic pump of claim 4, wherein each piston from the first and second pluralities of cylinders contacts a wear-resistant pad when engaged by the rotation of the shaft.

11. The hydraulic pump of claim 4, wherein when the shaft is rotated in the first direction the hydraulic pump generates a lower volume, higher pressure output and when the shaft is rotated in the second direction the hydraulic pump generates a higher volume, lower pressure output.

12. The hydraulic pump of claim 4, wherein the hydraulic pump is operated by application of force which when the shaft is rotated in the first direction is less than the force used to operate the hydraulic pump when the shaft is rotated in the second direction.

13. The hydraulic pump of claim 4, wherein the hydraulic pump may operate at multiple speeds and operates at a greater speed when the shaft is rotated in the first direction than when the shaft is rotated in the second direction.

14. The hydraulic pump of claim 4, wherein both the pistons of the first plurality of cylinders and the first plurality of cylinders are smaller than the pistons of the second plurality of cylinders and the second plurality of cylinders.

15. A sailboat having a hydraulic pump comprising:

a body having a central shaft assembly at least partially mounted within the body, the central shaft assembly including a selective engagement mechanism;

a first group of cylinders and a second group of cylinders, both the first group of cylinders and the second group of cylinders positioned radially about the central shaft assembly;

a piston disposed in each cylinder of the first group of cylinders and second group of cylinders, wherein each piston is moveable within its cylinder and outward movement of the piston in the cylinder pumps hydraulic fluid;

wherein operation of the central shaft assembly in a first orientation will cause the selective engagement mechanism to move the pistons only in the second group of cylinders and not the pistons in the first group of cylinders; and wherein operation of the central shaft assembly in a second orientation will cause the selective engagement mechanism to move the pistons in both the first group of cylinders and the second of cylinders.

16. The sailboat having a hydraulic pump of claim 15, wherein the central shaft assembly has a first portion and a second portion, the first portion adapted to move the pistons in the first group of cylinders and the second portion adapted to move the pistons in the second group of cylinders.

17. The sailboat having a hydraulic pump of claim 15, wherein when the central shaft assembly is operated a hydraulic output is generated which is used to provide a force causing the sailboat to perform sailing maneuvers.

18. The sailboat having a hydraulic pump of claim 15, wherein the hydraulic pump is actuated by application of force which is generated by a human.

19. The sailboat having a hydraulic pump of claim 15, wherein the central shaft assembly has an end and the end has peripheral splines such that the central shaft assembly may be connected to a human operable engagement device.

* * * * *